US012005488B2

(12) United States Patent
Grumm et al.

(10) Patent No.: US 12,005,488 B2
(45) Date of Patent: Jun. 11, 2024

(54) CAN SEAMER HAVING AN AUTOMATED SEALING ROLLERS

(71) Applicant: Oktober, LLC, Grand Rapids, MI (US)

(72) Inventors: Dennis Grumm, Grand Rapids, MI (US); Svend Sorensen, Grand Rapids, MI (US)

(73) Assignee: OKTOBER, LLC, Grand Rapids, MI (US)

( * ) Notice: Subject to any disclaimer, the term of this patent is extended or adjusted under 35 U.S.C. 154(b) by 0 days.

(21) Appl. No.: 17/985,836

(22) Filed: Nov. 12, 2022

(65) Prior Publication Data

US 2024/0157429 A1 May 16, 2024

(51) Int. Cl.

| | |
|---|---|
| ***B21D 51/30*** | (2006.01) |
| ***B21D 51/26*** | (2006.01) |
| ***B21D 51/32*** | (2006.01) |

(52) U.S. Cl.

CPC ..... *B21D 51/32* (2013.01); *B21D 51/2661* (2013.01)

(58) Field of Classification Search

CPC ..... B21D 51/30; B21D 51/32; B21D 51/34

See application file for complete search history.

(56) References Cited

U.S. PATENT DOCUMENTS 5,125,208 A * 6/1992 Tsukada ..... B21D 51/30 53/308

FOREIGN PATENT DOCUMENTS

WO WO-2021045335 A1 * 3/2021 ..... B21D 51/2653

* cited by examiner

*Primary Examiner* — Debra M Sullivan

(74) *Attorney, Agent, or Firm* — Jovan N. Jovanovic; The Watson IP Group, PLC

(57) ABSTRACT

A can seamer comprising a frame, a lower chuck, an upper chuck, a first and second seam forming assembly, a seam drive assembly and a motor. The upper chuck having an axle. The seam forming assemblies including a first roller. The seam drive assembly includes a cam, a first roller follower and a second roller follower. A cam transmission assembly includes a drive gear rotatably coupled to the axle, an idler assembly and a cam gear coupled to the cam. The idler assembly includes an idler axle that is spaced apart from the axle. A first idler gear engages the drive gear, and a second idler gear with the first and second idler gears being rotatably coupled to the idler axle. The cam gear engages the second idler gear. The motor has an output shaft rotatably coupled to the axle.

20 Claims, 9 Drawing Sheets

CAN SEAMER HAVING AN AUTOMATED SEALING ROLLERS

CROSS-REFERENCE TO RELATED APPLICATION

N/A

BACKGROUND OF THE DISCLOSURE

1. Field of the Disclosure

The disclosure relates in general to a container forming apparatus, and more particularly, to a can seaming apparatus that is configured to form the double seam can seal on a can in an automated manner (with manual placement of the can into the desired orientation, preferably). While not limited thereto, the apparatus is well suited for the application of a double seam can seal on a typical aluminum beverage can (such as what is known as a beer can). Of course, this is to be deemed exemplary and is not to be deemed limiting.

2. Background Art

The manufacture of cans is known in the art. For example, beverage cans are formed from a lower can portion and an upper can cap. With a typical can configuration, the can includes an upper outward flange. The cover includes a cover curl that extends over the end of the flange and below the flange. In a first operation, a roller directs the cover between the flange and the body to form an initial crimp (first seam). Next, in a second operation, a second roller flattens the seam to complete the double seam can seal.

While equipment for coupling the upper can top to the can is known, current equipment has many drawbacks. First, much of the available equipment comprises larger equipment that is configured to continuously, and in an automated fashion, seal successive cans. Such equipment is not suitable or efficient for smaller batch production. Moreover, for small batch production, such equipment is too costly to purchase and operate.

Other solutions exist that are more well suited to smaller batch production. Many of such solutions provide for the manual placement of the can and cap. Subsequently, the forming rollers are sequentially manually rotated or otherwise moved into contact with the can to form the seams of the double seam can seal.

This application is related to, but does not claim priority from, U.S. Pat. App. Ser. No. 62/330,072 filed Apr. 30, 2016, entitled "Can Seaming Apparatus", U.S. patent application Ser. No. 15/581,190, filed Apr. 28, 2017, entitled "Can Seaming Apparatus", and U.S. patent application Ser. No. 16/156,742, filed Oct. 10, 2018, entitled "Can Seaming Apparatus", the entire disclosures of each of which are hereby incorporated by reference in their entireties.

SUMMARY OF THE DISCLOSURE

The disclosure is directed to a can seamer comprising a frame, a lower chuck, an upper chuck, a first seam forming assembly, a second seam forming assembly, a seam drive assembly and a motor. The lower chuck is rotatably coupled to the frame. The upper chuck is rotatably coupled to the frame. One of the upper chuck and the lower chuck is movable so as to releasably engage a can and a cap therebetween. The upper chuck is rotatably coupled to an axle having an axle axis of rotation. The first seam forming assembly includes a first rotating shaft that is rotatable relative to the frame and that is positioned to a first side of the upper chuck. A first roller is attached thereto at a lower end thereof. The second seam forming assembly includes a second rotating shaft that is rotatable relative to the frame and that is positioned to a second side of the upper chuck. A second roller is attached thereto at a lower end thereof. The seam drive assembly comprises a cam, a first roller follower assembly, a second roller follower assembly and a cam transmission assembly. The cam is rotatable about the axle axis of rotation and has an outer surface. The first roller follower assembly is coupled to a first end of the first rotating shaft, and includes a follower configured to follow the outer surface of the cam. The first roller is biased against the outer surface of the cam. The second roller follower assembly is coupled to a first end of the second rotating shaft, and includes a follower configured to follow the outer surface of the cam. The second roller is biased against the outer surface of the cam. The cam transmission assembly comprises a drive gear, an idler assembly and a cam gear. The drive gear is rotatably coupled to the axle. The idler assembly has an idler axle that is spaced apart from the axle, and that includes a first idler gear that engages the drive gear, and a second idler gear. The first and second idler gears are rotatably coupled to the idler axle. The cam gear is rotatably coupled to the cam. The cam gear is positioned so as to engage the second idler gear. The motor has an output shaft that is rotatably coupled to the axle.

In some configurations, an angular position of the first rotating shaft and the first roller follower assembly is adjustable.

In some configurations, the first rotating shaft includes an outer surface and a fastener surface. The first roller follower assembly includes a central opening with a pair of spaced apart transverse bores. A first fastener extends through a first of the pair of spaced apart transverse bores and engaging the fastener surface. A second fastener extends through a second of the pair of spaced apart transverse bores and engaging the fastener surface.

In some configurations, the first seam forming assembly further includes a first roller support arm at a lower end of the first rotating shaft. The first roller support arm has a distal end, with an adjustable stop at the distal end of the first roller support arm. The roller is coupled to the first roller support between the first rotating shaft and the adjustable stop.

In some configurations, the first adjustable stop has a fastener threaded into the first roller support arm. The fastener has a chuck interface surface configured to interface with the upper chuck.

In some configurations, the first roller follower rotates about an axis that is parallel to an axis defined by the first rotating shaft.

In some configurations, an angular position of the second rotating shaft and the second roller follower assembly is adjustable.

In some configurations, the second rotating shaft includes an outer surface and a fastener surface. The second roller follower assembly includes a central opening with a pair of spaced apart transverse bores, with a first fastener extending through a first of the pair of spaced apart transverse bores and engaging the fastener surface. A second fastener extends through a second of the pair of spaced apart transverse bores and engaging the fastener surface.

In some configurations, the second seam forming assembly further includes a second roller support arm at a lower end of the second rotating shaft. The second roller support arm has a distal end, with an adjustable stop at the distal end of the second roller support arm. The roller is coupled to the second roller support between the second rotating shaft and the adjustable stop.

In some configurations, the second adjustable stop comprises a fastener threaded into the second roller support arm. The fastener has a chuck interface surface configured to interface with the upper chuck.

In some configurations, the second roller follower rotates about an axis that is parallel to an axis defined by the second rotating shaft.

In some configurations, the axle and the idler axle are parallel to each other in a space apart configuration.

In some configurations, the motor includes an output shaft, wherein the output shaft is parallel to the axle and the idler axle.

In some configurations, the lower chuck is slidably movable relative to the frame toward and away from the upper chuck.

In some configurations, the lower chuck is coupled to an overcenter mechanism, structurally configured to lock the lower chuck relative to the upper chuck.

In some configurations, the cam further includes a cam lobe defined on the outer surface, and, a slot defined in the cam proximate the cam lobe.

In some configurations, the frame further includes an upper frame portion, with the first rotating shaft, the second rotating shaft and the axle each extending through an opening in the upper frame portion.

In some configurations, the frame further includes a rear projection extending in a direction away from the upper frame portion and terminating at a distal end. The first roller follower assembly includes a first return spring coupled to a body of the first roller follower at a first end and to the rear projection at a second end. The second roller follower assembly includes a second return spring coupled to the a body of the second roller follower at a first end and to the rear projection at a second end.

In some configurations, the second end of the first return spring and the second end of the second return spring are positioned closer to each other than the first end of the first return spring and the first end second return spring.

In some configurations, the first and second return springs extend under the first idler gear.

BRIEF DESCRIPTION OF THE DRAWINGS

The disclosure will now be described with reference to the drawings wherein.

DETAILED DESCRIPTION OF THE DISCLOSURE

Figure 1:
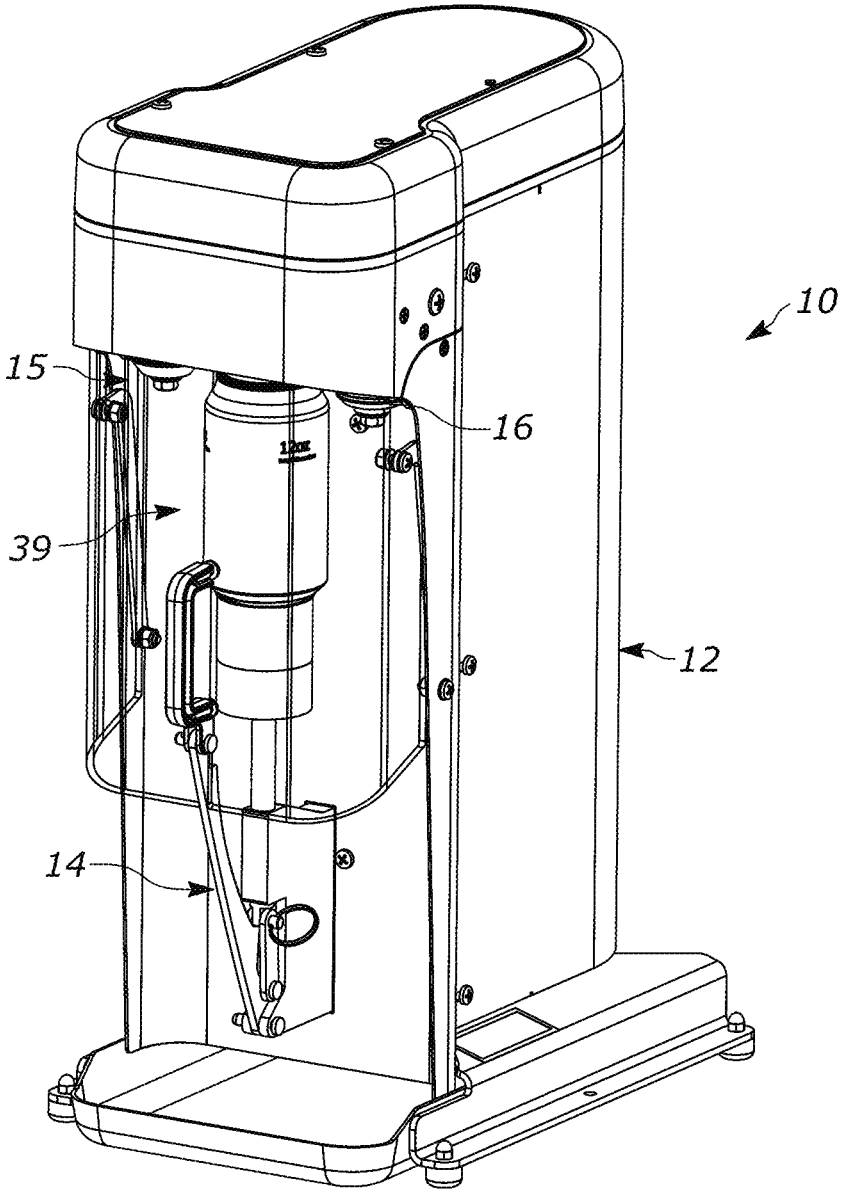
FIG. 1 of the drawings is a perspective view of the can seamer of the present disclosure.
Figure 2:
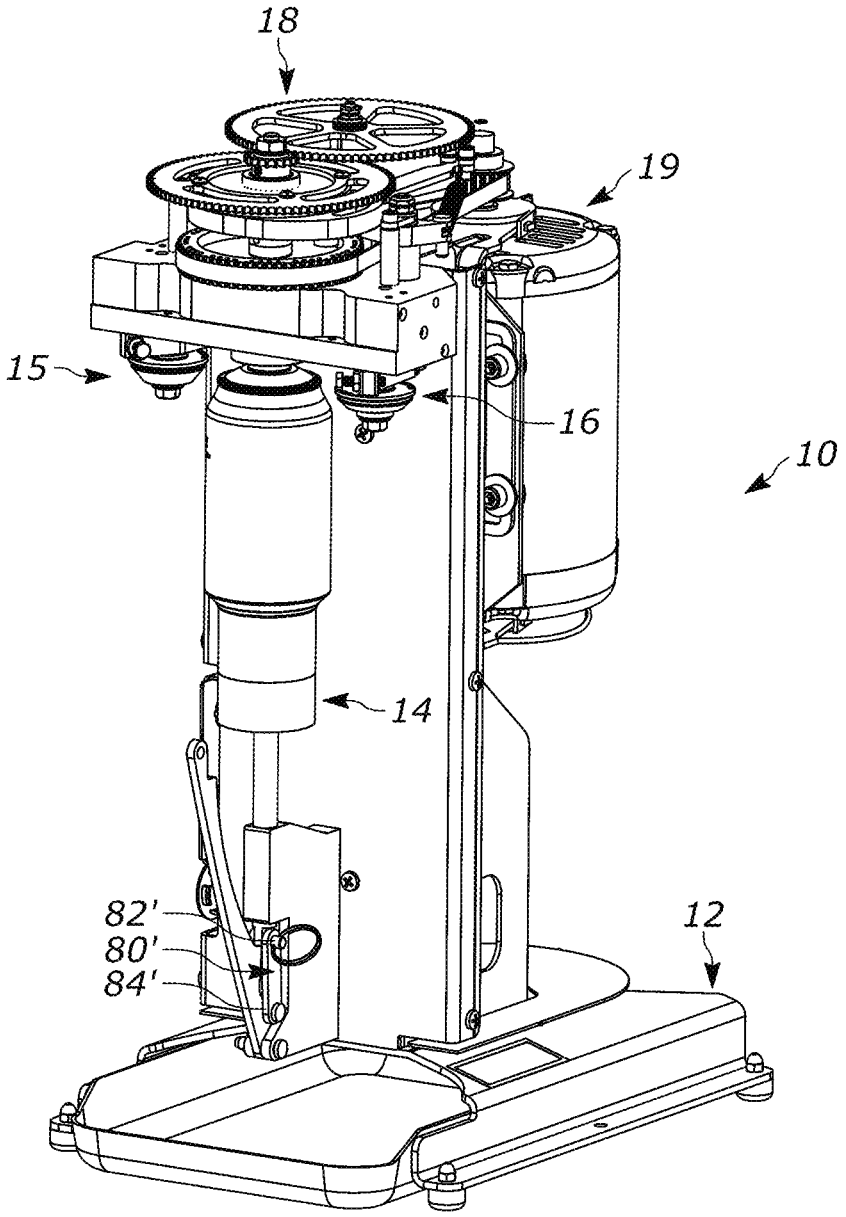
FIG. 2 of the drawings is a left perspective view of the can seamer of the present disclosure with portions of the frame cover removed.
Figure 3:
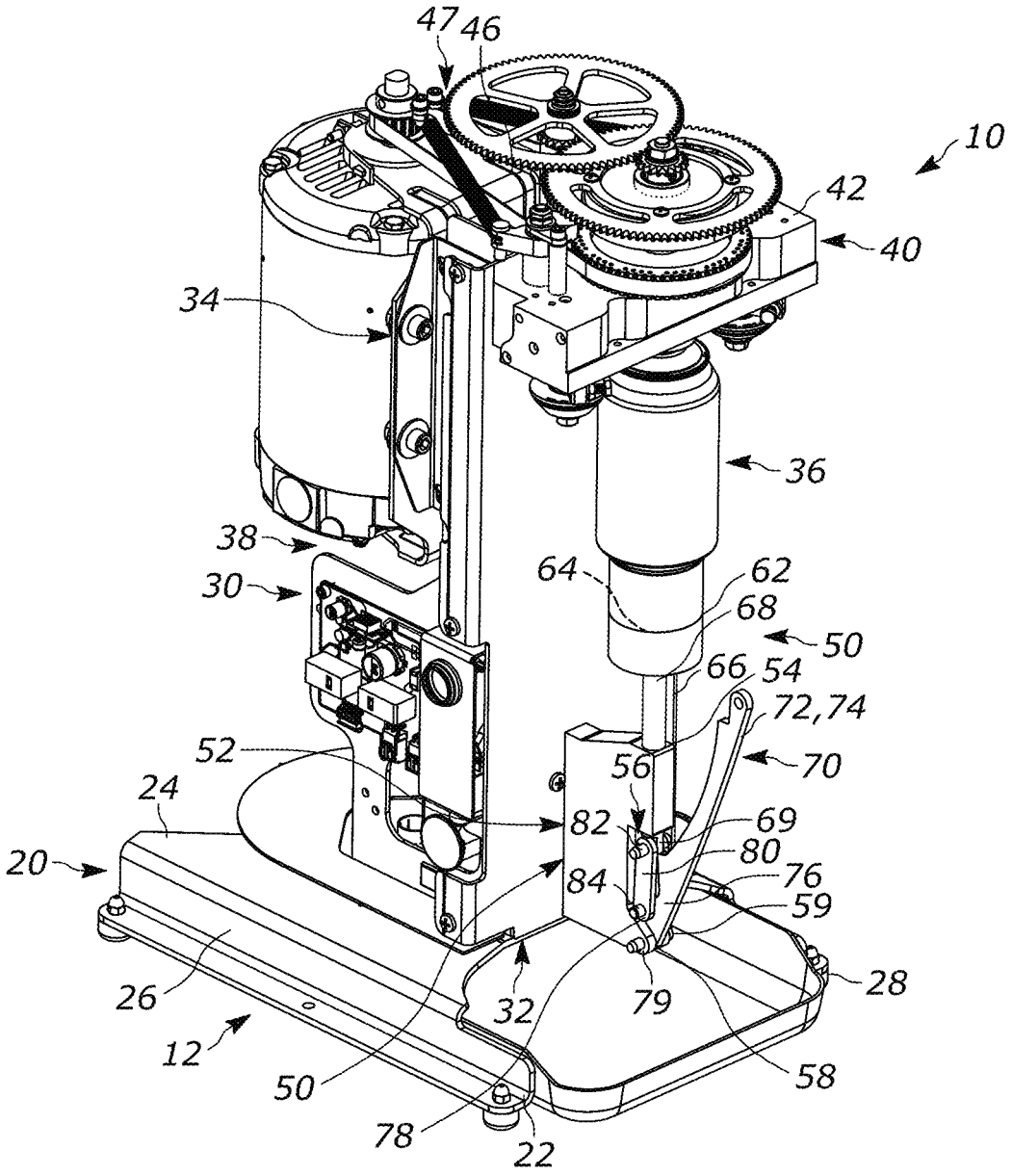
FIG. 3 of the drawings is a right perspective view of the can seamer of the present disclosure with portions of the frame cover removed.
Figure 4:
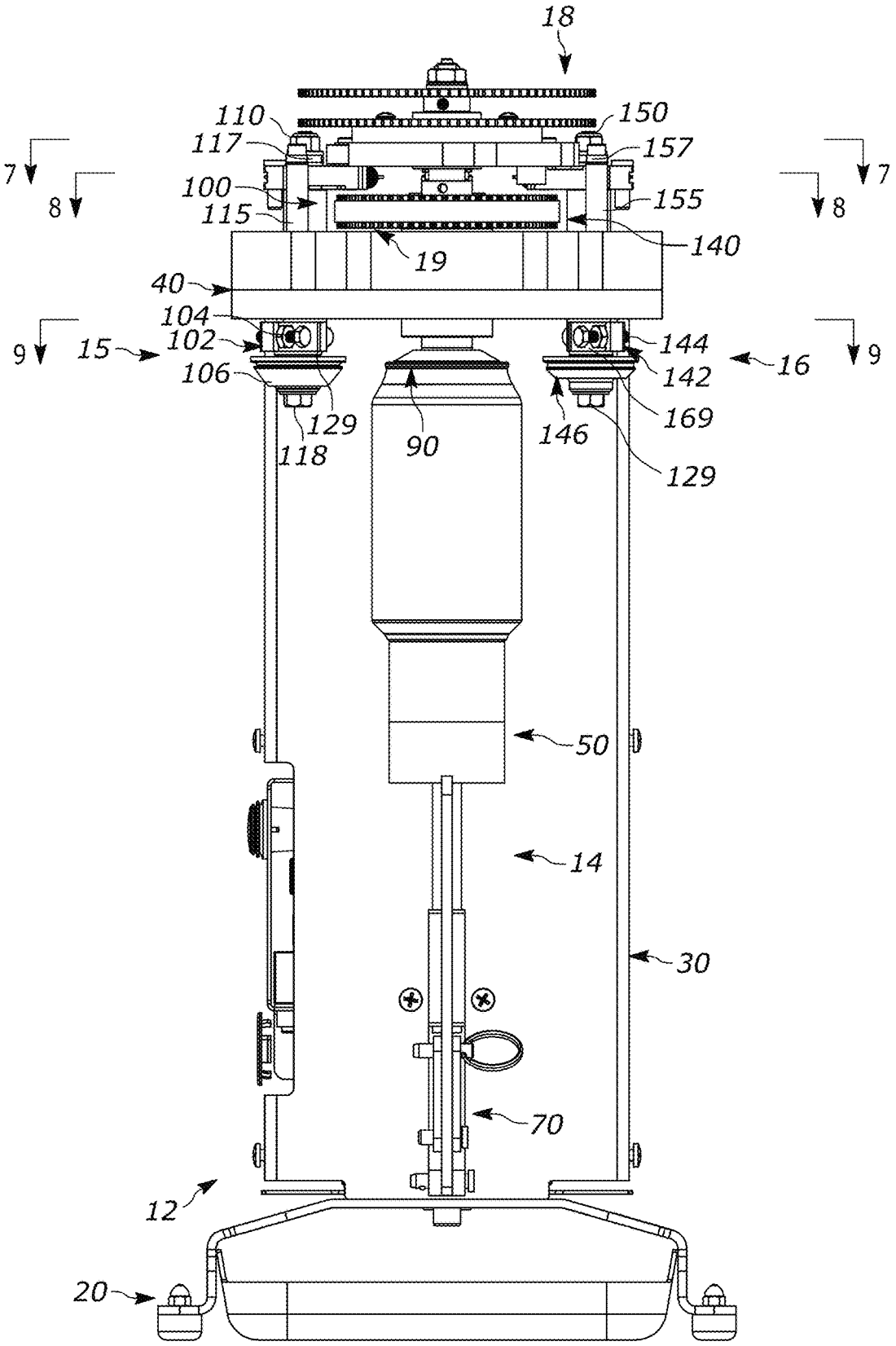
FIG. 4 of the drawings is a front elevational view of the can seamer of the present disclosure with portions of the frame cover removed.

While this disclosure is susceptible of embodiment in many different forms, there is shown in the drawings and described herein in detail a specific embodiment(s) with the understanding that the present disclosure is to be considered as an exemplification and is not intended to be limited to the embodiment(s) illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIG. 1, the can seamer is shown generally at 10. The can seamer 10 is suitable for use in association with the seaming of cans filled with liquids (or solids), such as beer, ciders, and the like (as well as solids, such as coffee grounds). The can seamer can be used for example on a countertop to seal cans that are manually loaded into the can seamer. Again, the disclosure is not limited thereto.

The can seamer 10, in greater detail, comprises frame 12, can handling assembly 14, first seam forming assembly 15, second seam forming assembly 16, seam drive assembly 18 and drive assembly 19. The frame 12 comprises base 20, upstanding support 30 and upper frame portion 40. The base 20 includes front end 22, back end 24 opposite the front end 22, first side 26 and second side 28. The base 20 comprise a sheet metal member which is formed to have depending legs on either side with flanges that can retain foot members. Such a configuration allows for the inclusion of a tray member between the depending legs which can catch liquids and/or solids that fall from the can during sealing.

The upstanding support 30 extends upwardly from the base 20 from a generally central location. The upstanding support 30 includes a lower end 32 proximate the base 20, an upper end 34, a front 36 and a back 38. The front 36 can include curved structures which can define a can handling cavity 39. In the configuration shown, the upstanding support forms the backbone of the can seamer wherein the remaining components can be directly or indirectly coupled thereto. In addition, in the configuration shown, the can handling assembly and the seam forming assemblies are positioned in the front of the upstanding support, with the motor 310 being positioned in the back of the upstanding support. Of course, other configurations are contemplated. The configuration shown provides a balanced can seamer wherein the base provides a solid support for the same. The upstanding support can be formed from multiple components that may comprise sheet metal, or the like, as well as machined components, and/or cast components.

The upper frame portion 40 further includes upper surface 42 and lower surface 44. The upper frame portion extends from the front of the upstanding support and provides a mounting structure for, among others, at least portions of, the upper chuck assembly, the first and second seam forming assemblies, and the seam drive assembly. The upper frame portion is formed from a machined metal member, preferably.

A rear beam 46 extends from the back of the upper end of the upstanding support in a direction opposite the upper frame portion, and terminates at a distal end 47.

Figure 5:
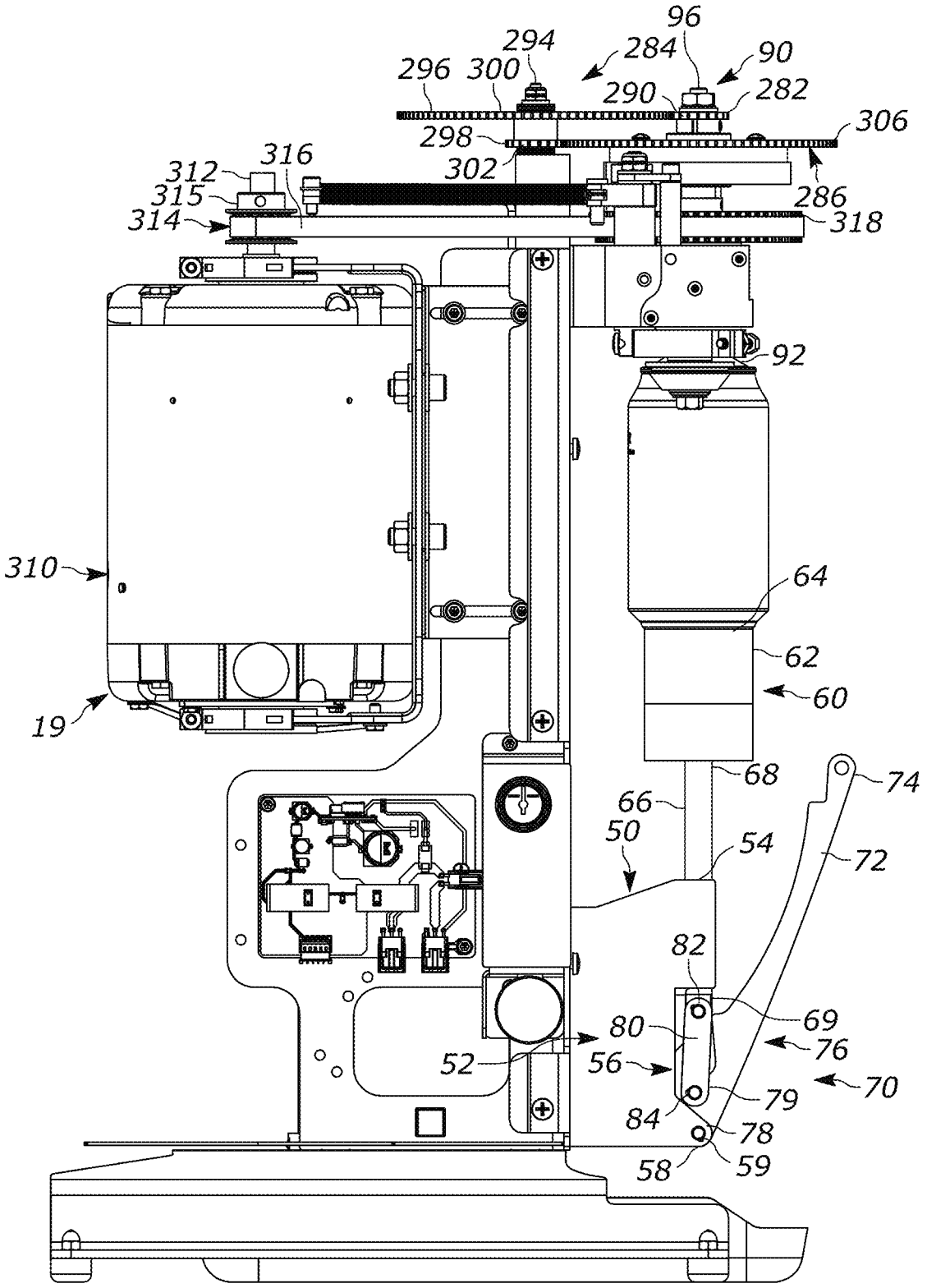
FIG. 5 of the drawings is a side elevational view of the can seamer of the present disclosure with portions of the frame cover removed.
Figure 6:
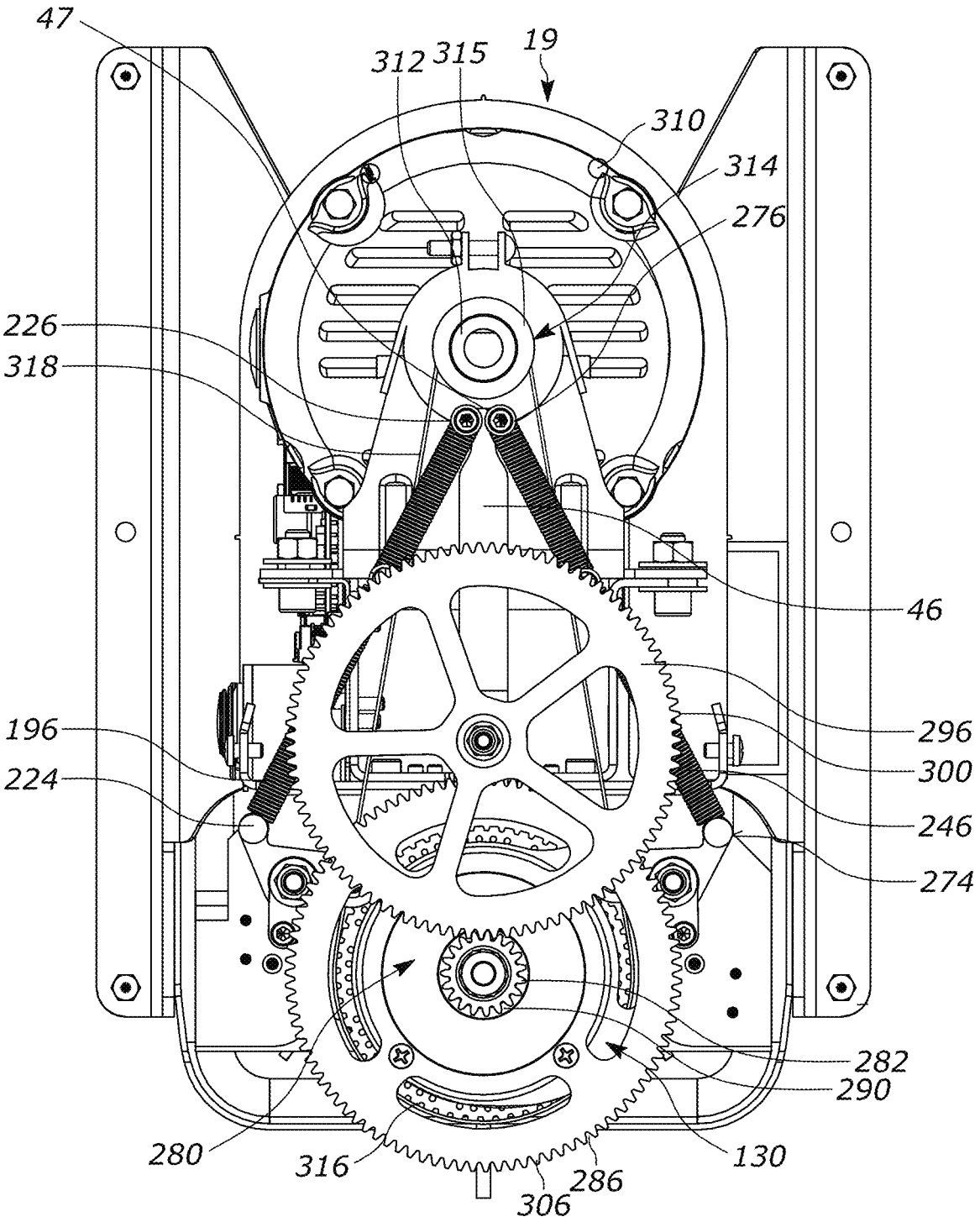
FIG. 6 of the drawings is a top plan view of the can seamer of the present disclosure with portions of the frame cover removed.
Figure 7:
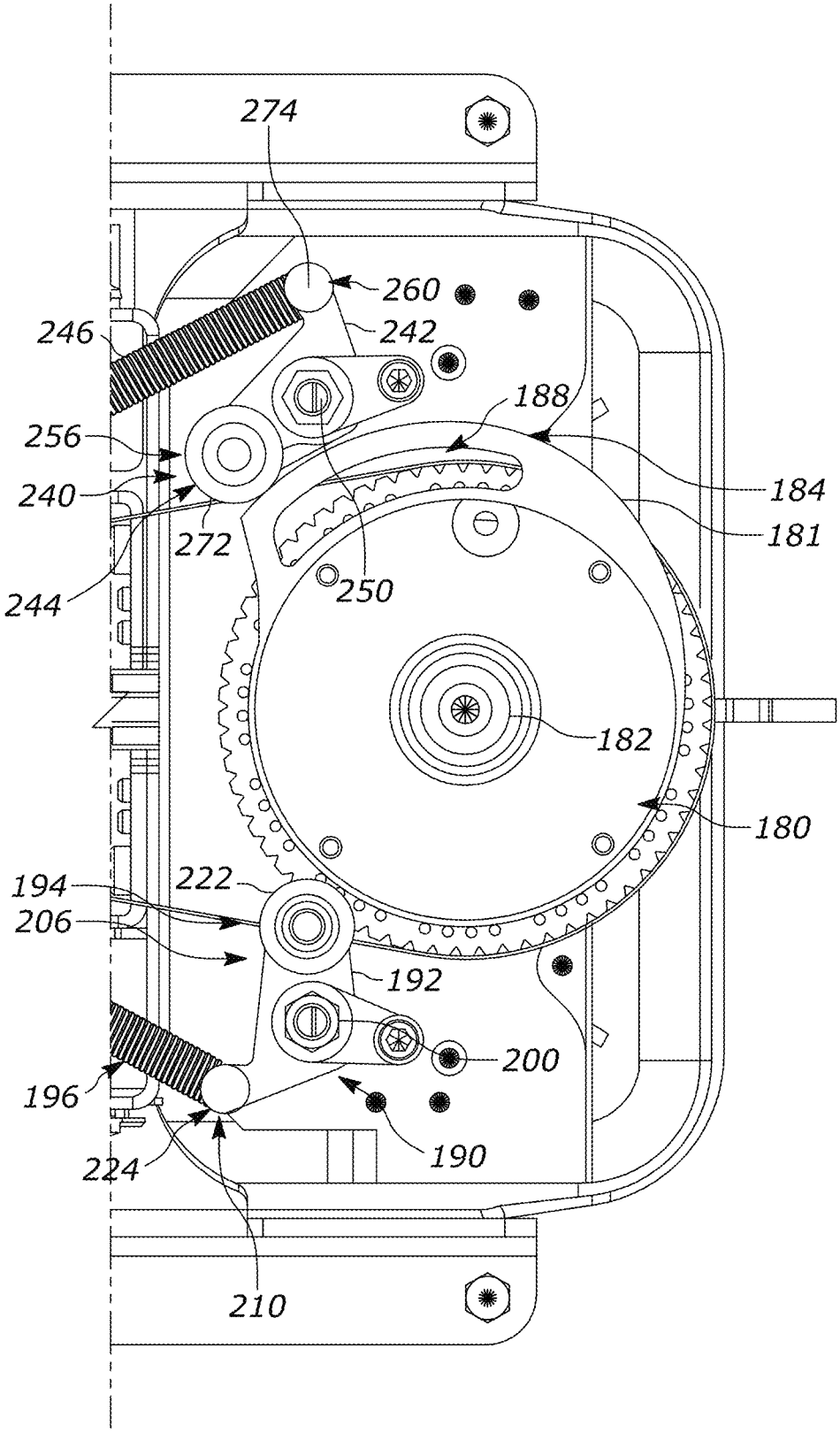
FIG. 7 of the drawings is a partial cross-sectional view of can seamer of the present disclosure with portions of the frame cover removed, taken generally about lines 7-7 of FIG. 4.
Figure 8:
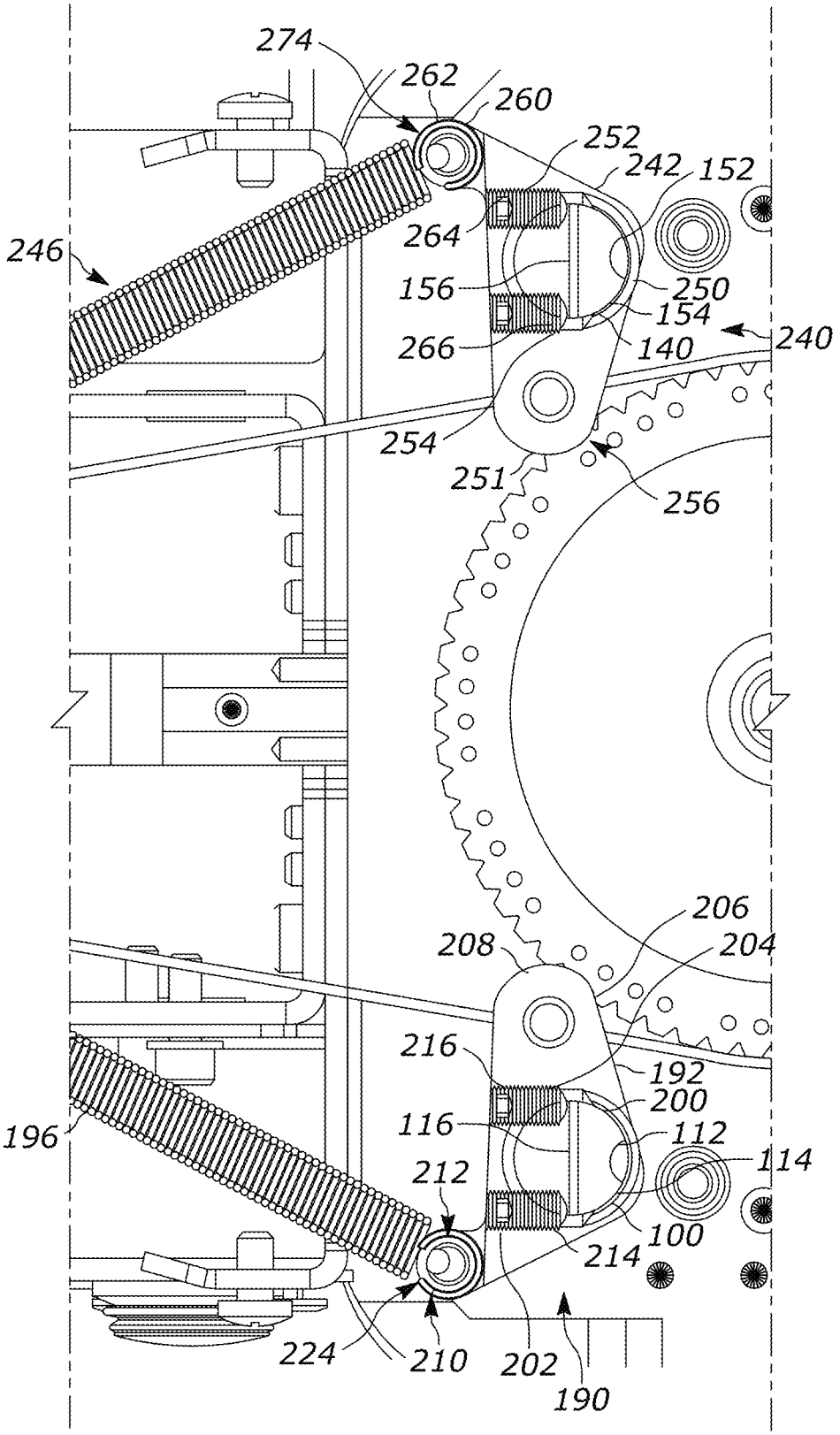
FIG. 8 of the drawings is a partial cross-sectional view of can seamer of the present disclosure with portions of the frame cover removed, taken generally about lines 8-8 of FIG. 4.
Figure 9:
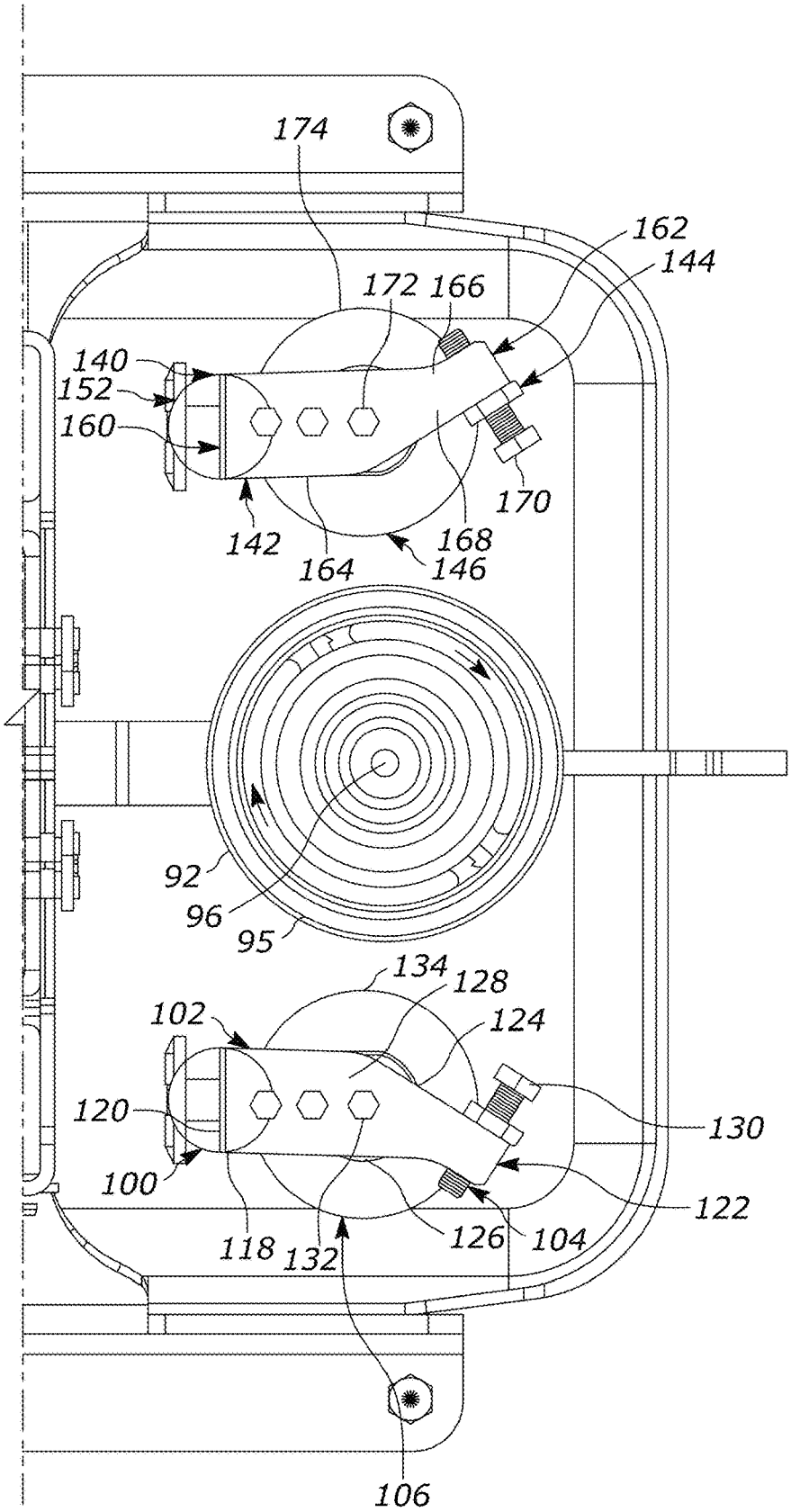
FIG. 9 of the drawings is a partial cross-sectional view of can seamer of the present disclosure with portions of the frame cover removed, taken generally about lines 9-9 of FIG. 4.

The can handling assembly 14 is shown in FIG. 5 as comprising lower chuck assembly 50 and upper chuck assembly 90. The lower chuck assembly 50 includes lower chuck frame 52, lower chuck 60 and linkage assembly 70. The lower chuck frame 52 is mounted to the front of the upstand support 30 and includes upper bore 54, slot 56 and lower channel 58. The upper bore is aligned substantially vertically, with the lower end of the upper bore opening into the slot 56. The lower channel 58 may include a transverse opening so as to receive a pivot pin.

The lower chuck 60 is shown as comprising can interface 62 and lower shaft 66. The can interface 62 includes an upper end which is configured to receive the lower end of a can (or a spacer which then is configured to receive the lower end of a can). The lower shaft 66 extends from the lower chuck and includes upper end 68 which is coupled to the shaft (i.e., rotationally and also in a configuration that allows some vertical translation relative to the shaft) and a lower end 69. The lower end 69 extends through the upper bore 54 of the lower chuck frame 52 and into the slot 56, and, the lower end includes a transverse opening extending therethrough. In the configuration shown, the lower shaft comprises a substantially uniform cylindrical member which is spring mounted to the can interface of the lower chuck, while allowing relative rotation therebetween, in the configuration shown, about an axis that is defined by the lower shaft.

The linkage assembly 70 is shown as comprising handle 72 as well as connector linkages 80, 80'. The handle 72 includes a first end 74 and a second end 76. The first end 74 may be coupled to a shield structure which, when the handle is in the retention orientation, the shield covers the region occupied by the rotating can. The second end 76 includes a first opening 78 and a second opening 79. The two openings are spaced apart from each other at the second end 76.

The connector linkages 80, 80' (of which there may be one or more) each include a pair of spaced apart openings, namely openings 82, 82' and 84, 84'. The openings are positioned at opposing ends of the connector linkages.

The lower opening at the second end of the handle 72 aligns with the transverse opening 59 of the lower chuck frame 52 and the two can be secured in pivotable engagement by a pin member. Similarly, the upper opening at the second end of the handle aligns with the lower openings 84, 84' of the connector linkages, and a pin can secure the components in rotational engagement. The upper openings 82, 82' of the connector linkages align with the transverse opening in the lower end of the lower shaft 66. It will be understood that when the handle is rotated, the lower chuck moves in an up and down configuration. With the relative size of the components of the linkage assembly, the assembly forms an overcenter mechanism wherein the handle can essentially extend over center with the connector linkages 80, 80' so as to maintain the lower chuck in a fixed, and releasably locked configuration.

It will be understood that the lower chuck assembly is configured to receive a can and to facilitate the sandwiching of the can between the lower chuck assembly and the upper chuck assembly. To that end, variations are contemplated, and, among others, configurations such as that which is disclosed in U.S. Pat. No. 10,751,785 issued to Grumm, or that which is disclosed in U.S. patent application Ser. No. 17/962,414 entitled "Power Tool Powered Can Seamer" filed by Grumm, the entire specification of both of which are hereby incorporated by reference in their entirety, are contemplated.

The upper chuck assembly 90 is shown as comprising can interface 92 and axle 96. The can interface 92 includes a lower surface 94 configured to engage and retain a cap of a can that is being sealed. The axle 96 is rotatably fixed to the can interface 92 at a lower end 97 with the axle 96 extending through an opening in the upper frame portion 40 and terminating at an upper end 98. The axle 96 (together with the can interface 92 of the upper chuck assembly and the lower chuck 60) defines the axis of rotation of the can during the seaming process. As will be explained below, the drive gear 282, the cam gear 286, the cam 180 and the cam cogged pulley 316 rotate with the axle 96 or relative to the axle 96 about the axis same of rotation as the axle 96. Generally, the axle 96 is preferably fixed (although it may be adjustable) relative to translation within the opening of the upper frame portion 40.

The first seam forming assembly 15 (which is configured to form one of the seams of a double seam, which is used to sealingly close a typical metal can) comprises first rotating shaft 100, first roller support arm 102, first adjustable stop 104 and first roller 106. The first rotating shaft 100 defines a first rotating shaft axis of rotation and includes upper end 110 and lower end 118, with the first rotating shaft 100 extending through an opening in the upper frame portion so that the upper end 110 is on one side (the upper side) of the upper frame portion, with the lower end 118 being on the other side (the lower side) of the upper frame portion. The upper end 110 includes follower coupling 112. The follower coupling 112 includes outer surface 114 and fastener surface 116 which, in the configuration shown comprises a cord that extends across the arcuate configuration of the outer surface.

A support beam 115 may be positioned proximate the first rotating shaft 100, with the upper end of the first rotating shaft 100 being coupled thereto through support link 117. The support beam and the support link provide additional stability and fixation of the rotating shaft and generally precludes the translative movement of the first rotating shaft relative to the upper frame portion.

At the lower end 118 of the first rotating shaft 100, the first roller support arm 102 is attached. The first roller support arm includes proximal end 120, distal end 122, inner side 124, outer side 126, upper side 128 and lower side 129. The proximal end 120 is coupled to the lower end of the first rotating shaft and is generally perpendicular (or oblique) to the axis of rotation of the first rotating shaft. The first adjustable stop 104 is positioned proximate the distal end 122 of the first roller support arm. The first adjustable stop 104 includes a chuck interface surface 130 which is configured to be interactable with the outer surface 95 of the can interface of the upper chuck assembly. In the configuration shown, the first adjustable stop comprises a fastener that is threaded into the inner side 124 of the first roller support arm, and which further includes a locking nut that can lock the fastener in a desired position relative to the first roller support arm.

The first roller 106 is shown as including roller axle 132 and roller outer forming surface 134. In the configuration shown, the roller axle 132 is parallel to the axis of rotation of the first roller support arm, while being offset therefrom. The roller axle 132 extends into the lower side 129 of the first roller support arm between the first adjustable stop (and the distal end) and the proximal end of the first roller support arm. The roller outer forming surface 134 is configured to engage the can and the cap of the can so as to form one of the double seams to seal the can. In the configuration shown, looking from above, the first rotating shaft is rotated in a counter clockwise direction to selectively engage the first roller with the can and cap, and in a clockwise direction to selectively disengage the first roller from the can and cap.

The second seam forming assembly 16 is shown as comprising second rotating shaft 140, second support arm 142, second adjustable stop 144 and second roller 146. The second rotating shaft 140 defines a second rotating shaft axis of rotation and includes upper end 150 and lower end 158, with the second rotating shaft 140 extending through an opening in the upper frame portion so that the upper end 150 is on one side (the upper side) of the upper frame portion, with the lower end 158 being on the other side (the lower side) of the upper frame portion. The upper end 150 includes follower coupling 152. The follower coupling 152 includes outer surface 154 and fastener surface 156 which, in the configuration shown comprises a cord that extends across the arcuate configuration of the outer surface.

A support beam 155 may be positioned proximate the second rotating shaft 140, with the upper end of the second rotating shaft 140 being coupled thereto through support link 157. The support beam and the support link provide additional stability and fixation of the rotating shaft and generally precludes the translative movement of the second rotating shaft relative to the upper frame portion.

At the lower end 158 of the second rotating shaft 140, the second roller support arm 142 is attached. The first roller support arm includes proximal end 160, distal end 162, inner side 164, outer side 166, upper side 168 and lower side 169. The proximal end 160 is coupled to the lower end of the second rotating shaft and is generally perpendicular (or oblique) to the axis of rotation of the second rotating shaft. The second adjustable stop 144 is positioned proximate the distal end 162 of the second roller support arm. The second adjustable stop 144 includes a chuck interface surface 170 which is configured to be interactable with the outer surface 95 of the can interface of the upper chuck assembly. In the configuration shown, the second adjustable stop comprises a fastener that is threaded into the inner side 164 of the second roller support arm, and which further includes a locking nut that can lock the fastener in a desired position relative to the second roller support arm.

The second roller 146 is shown as including roller axle 172 and roller outer forming surface 174. In the configuration shown, the roller axle 172 is parallel to the axis of rotation of the second roller support arm, while being offset therefrom. The roller axle 172 extends into the lower side 169 of the second roller support arm between the second adjustable stop (and the distal end) and the proximal end of the second roller support arm. The roller outer forming surface 134 is configured to engage the can and the cap of the can so as to form one of the double seams to seal the can. In the configuration shown, looking from above, the second rotating shaft is rotated in a clockwise direction to selectively engage the second roller with the can and cap, and in a counter clockwise direction to selectively disengage the second roller from the can and cap.

The seam drive assembly 18 is shown as comprising cam 180, first roller follower assembly 190, second roller follower assembly 240, cam transmission assembly 280. The cam 180 is shown as including outer surface 181 and central hub 182 which corresponds to the axle 96 of the upper chuck assembly. A cam lobe 184 is defined on the outer surface 181. A slot 188 is defined in the cam 180 inboard to the cam lobe 184. In the configuration, the cam 180 is formed of a resilient, yet flexible material, such as a nylon, for example. Of course, other materials are contemplated. The nylon material allows for a degree of elastic deformation of the cam (especially when a force is applied inwardly on the cam lobe 184.

The first roller follower assembly 190 is shown as comprising body 192, first follower 194 and first return spring 196. The body 192 defines a central opening 200, and includes follower projection 206 and return projection 210 angularly offset from the follower projection. The central opening 200 further includes a first transverse bore 202 and a second transverse bore 204. The central opening 200 is configured to extend about the follower coupling 112 and aligned so that when fasteners 214, 216 are threaded into the respective one of the first transverse bore 202 and the second transverse bore 204, the ends of the fasteners engage the fastener surface 116. In such a configuration, the body 192 is fixedly coupled to the first rotating shaft 100.

The follower projection 206 extends from the region of the central opening 200 in an outward direction, and terminates at distal end 208. The return projection 210 extends in an angularly offset direction from the follower projection 206. The return projection terminates at a distal end 212. The distal end may include a structure 220 that is configured for retaining the first end 224 of return spring 196. In the configuration shown, the structure 220 comprises a transverse slot to receive the first spring, and opposing openings through which a pin can be extended to secure the first spring within the slot.

The first follower 194 includes contact surface 222. In the configuration shown, the first follower 194 comprises a roller follower that is rotatably coupled to the follower projection, and which is configured to matingly engage the outer surface 186 of the cam 180. The first return spring 196, as mentioned, is coupled at a first end 224 to the distal end of the return projection 210. The second end 226 of the spring is coupled to the distal end 47 of the rear beam 46 of the frame. In the configuration shown, the second end of the spring can engage a pin on the rear beam. The spring biases (i.e., applies a biasing force to) the contact surface 222 toward and into contact with the outer surface 181 of the cam 180. Advantageously, the first (and the second) springs extend from the return projection a distance that is beyond the footprint of the idler gears. This allows for a larger/longer spring that is outside of the cam gear and that runs below the upper idler gear, all of which results in a smaller footprint. Additionally, the second ends of the spring approach each other at the second ends thereof, again minimizing the footprint, while having a desirable mechanical advantage.

The second roller follower assembly 240 is shown as comprising body 242, second follower 244 and second return spring 246. The body 242 defines a central opening 250, and includes follower projection 256 and return projection 260 angularly offset from the follower projection. The central opening 250 further includes a first transverse bore 252 and a second transverse bore 254. The central opening 250 is configured to extend about the follower coupling 152 and aligned so that when fasteners 264, 266 are threaded into the respective one of the second transverse bore 252 and the second transverse bore 254, the ends of the fasteners engage the fastener surface 156. In such a configuration, the body 242 is fixedly coupled to the second rotating shaft 140.

The follower projection 256 extends from the region of the central opening 250 in an outward direction, and terminates at distal end 258. The return projection 260 extends in an angularly offset direction from the follower projection 256. The return projection terminates at a distal end 262. The distal end may include a structure 270 that is configured for retaining the first end 274 of return spring 246. In the configuration shown, the structure 270 comprises a transverse slot to receive the second spring, and opposing openings through which a pin can be extended to secure the second spring within the slot.

The second follower 244 includes contact surface 272. In the configuration shown, the second follower 244 comprises a roller follower that is rotatably coupled to the follower projection, and which is configured to matingly engage the outer surface 186 of the cam 180. The second return spring 246, as mentioned, is coupled at a first end 274 to the distal end of the return projection 260. The second end 276 of the spring is coupled to the distal end 47 of the rear beam 46 of the frame. In the configuration shown, the second end of the spring can engage a pin on the rear beam. The spring biases (i.e., applies a biasing force to) the contact surface 272 toward and into contact with the outer surface 181 of the cam 180.

The cam transmission assembly 280 is shown as comprising drive gear 282, idler assembly 284 and cam gear 286. The drive gear 282 is fixedly coupled to the axle 96 at the upper end 98 thereof, so as to rotate therewith. The drive gear includes a plurality of teeth 290.

The idler assembly 284 comprises idler axle 294, first idler gear 296 and second idler gear 298. The idler axle 294 is rotatably coupled to the frame and oriented so as to be parallel to and offset from the axle 96. The first idler gear 296 is rotationally fixed to the idler axle 294 and includes teeth 300. The first idler gear 296 meshes with the drive gear, and so as to achieve a gear reduction in the configuration shown, the first idler gear has a diameter that is larger than the diameter of the drive gear 282. The second idler gear 298 is rotationally fixed to the idler axle 294 and includes teeth 302.

The cam gear 286 is coupled to the cam 180 so as to rotate therewith. The cam gear 286 (and the cam 180) rotate bout the axle 96 and the axis of rotation defined by the axle 96, while not being rotatably coupled thereto. The cam gear 286 includes teeth 306, and is in meshing configuration with the second idler gear 298. In the configuration shown, the cam gear has a diameter that is larger than that of the second idler gear 298.

It will be understood that the different gears may have different configurations so as to achieve the desired relative rotational speed of the axle 96 of upper chuck assembly 90 and the cam 180. In the configuration shown, the cam gear has the largest diameter, followed by the first idler gear, then the second idler gear and the drive gear. It is contemplated that in place of the gears, belts and pulleys can be utilized. Advantageously, with the present system, a desired gear reduction can be achieved, while having the cam and the can rotate about the same axis of rotation. This further reduces the footprint of the can seamer and likewise provides an efficient configuration, minimizing the parts necessary to achieve the desired relative rotation of the components.

The drive assembly 19 is shown as comprising motor 310 and motor transmission 314. The motor 310 includes an output shaft 312. In the configuration shown, the motor 310 is mounted to the upstanding support 30 of the frame (directly or indirectly) with the output shaft 312 defining an axis of rotation that is substantially parallel to the axle 96 and the idler axle 294. Other configurations are contemplated. Advantageously, however, this further provides stability to the frame as well as minimizing both componentry and the footprint of the can seamer. The motor transmission 314 comprises a motor cogged pulley 315 rotationally fixed to the output shaft of the motor 312. Further the motor transmission 314 includes a can cogged pulley 316 which is fixedly coupled to the axle 96 so as to rotate therewith. A cogged belt 318 couples the two pulleys in rotational engagement. To achieve the desired rotation rate of the axle 96, the motor cogged pulley 315 is smaller than the can cogged pulley 316.

In operation, it is desirable to adjust the first and second seam forming assemblies 15, 16. To achieve the same, the first adjustable stop 104 can be moved so as to determine the desired end position of the first roller support arm, and, in turn, the roller outer forming surface 134 of the first roller 106. Once adjusted and set, then the relative angular position of the first roller follower assembly 190 can be adjusted relative to the first rotating shaft 100. This is achieved by altering the orientation of the first fastener 214 and the second fastener 216 in the first and second transverse bores 202, 204 of the body 192 of the first roller follower assembly 190. As one of the two fasteners is retracted, while the other is advanced, due to the position of the fasteners relative to the fastener surface 116, the relative angular position of the first rotating shaft and the body of the first roller follower assembly can be adjusted. Once positioned as desired, the fasteners can be advanced so as to fixedly engage the two structures together. It will be understood that there may be a bit of preloading on the cam surface when the cam lobe is reached, and in such a configuration, the slot 188 provides a level of compliance.

Similarly, the same adjustment can be made to the second seam forming assembly 16. In particular, the second adjustable stop 144 can be moved so as to determine the desired end position of the second roller support arm, and, in turn, the roller outer forming surface 174 of the second roller 146. Once adjusted and set, then the relative angular position of the second roller follower assembly 240 can be adjusted relative to the second rotating shaft 140. This is achieved by altering the orientation of the first fastener 264 and the second fastener 266 in the first and second transverse bores 252, 254 of the body 242 of the second roller follower assembly 240. As one of the two fasteners is retracted, while the other is advanced, due to the position of the fasteners relative to the fastener surface 156, the relative angular position of the second rotating shaft and the body of the second roller follower assembly can be adjusted. Once positioned as desired, the fasteners can be advanced so as to fixedly engage the two structures together. It will be understood that there may be a bit of preloading as with the first seam forming assembly.

In operation, a can and cap is introduced into the can handling cavity 39 and engaged with the can handling assembly 14. To achieve the same an empty can or a can filled with a solid or liquid can be placed on the can interface of the lower chuck, and, a cap can be placed over the top of the can. The user can actuate the linkage assembly to direct the lower chuck toward the upper chuck assembly. Eventually, the cap (and potentially the upper portion of the can)

contacts the upper chuck, and the can is securely sandwiched between the upper and lower chucks. The can handling assembly centers the can and cap about the axis of rotation defined by the axle 96 of the upper chuck assembly. It will be understood that the handle can be coupled to a shield and the with the releasable securement of the can and cap, the shield is transferred into a desired orientation covering the can handling cavity.

Once positioned and secured, the can seamer can be actuated (this can be done through suitable power and controls that provide electrical power to the motor 310. As the motor rotates, the motor transmission 314 initiates rotation of the axle 96 which spins the cap and the can. At the same time, the rotation of the axle 96 rotates the drive gear 282, which then rotates the idler assembly, namely, the idler axle, and the first and second idler gears, and, in turn, the cam gear 286. The cam gear 286 is coupled to the cam 180, and, as such, the cam 180 rotates about the axis of rotation of the axle 96.

As the cam rotates 180, the cam lobe reaches the first follower 194 and the first follower is directed outwardly (away from the axle 96), rotating the first rotating shaft 100 in a counter clockwise direction. This rotation directs the first roller 106 toward the can and cap so that the roller outer forming surface 134 of the first roller forms one of the seals with the can and cap. As the cam lobe passes, the first rotating shaft 100 rotates in a clockwise direction, which then moves the first roller away from the can and cap.

As the cam continues to rotate, the cam lobe 184 reaches the second follower 244 and the second follower is directed outwardly (away from the axle 96), rotating the second rotating shaft 140 in a clockwise direction. This rotation directs the second roller 144 toward the can and cap so that the roller outer forming surface 130 of the second roller forms the other of the seals with the can and cap. As the cam lobe passes, the second rotating shaft 140 rotates in a counter clockwise direction, which then moves the second roller away from the can and the cap.

When both of the rollers have contacted and deformed the cap and can, the can is fully sealed with the double seal. Once completed, the user can remove the can in a manner that reverses that which was done initially. The apparatus is ready to receive another can and cap. That is, the process can be repeated.

It will be understood that covers and the like can be provided so as to provide an aesthetically pleasing look, while also protecting the components (and minimizing injury). And, as discussed above, a front shield can be provided to minimize any splatter or other debris that may be flung from the can during the seaming process. Such a shield can be coupled to the handle so as to automatically be in the correct position based upon whether or not a can is sandwiched by the upper and lower chucks.

Other variations are likewise contemplated, including, but not limited to other transmissions to direct the power from the motor to the axle 96 to the cam 180. Advantageously, the present disclosure minimizes componentry and footprint, while permitting smooth operation.

The foregoing description merely explains and illustrates the disclosure and the disclosure is not limited thereto except insofar as the appended claims are so limited, as those skilled in the art who have the disclosure before them will be able to make modifications without departing from the scope of the disclosure.

What is claimed is:

1. A can seamer comprising:

a frame;

a lower chuck rotatably coupled to the frame;

an upper chuck rotatably coupled to the frame, one of the upper chuck and the lower chuck movable so as to releasably engage a can and a cap therebetween, the upper chuck rotatably coupled to an axle having an axle axis of rotation;

a first seam forming assembly including a first rotating shaft, rotatable relative to the frame and positioned to a first side of the upper chuck, with a first roller attached thereto at a lower end thereof;

a second seam forming assembly including a second rotating shaft, rotatable relative to the frame and positioned to a second side of the upper chuck, with a second roller attached thereto at a lower end thereof, a seam drive assembly comprising a cam rotatable about the axle axis of rotation, the cam having an outer surface;

a first roller follower assembly coupled to a first end of the first rotating shaft, and including a first roller follower configured to follow the outer surface of the cam, the first follower being biased against the outer surface of the cam;

a second roller follower assembly coupled to a first end of the second rotating shaft, and including a second roller follower configured to follow the outer surface of the cam, the second roller follower being biased against the outer surface of the cam;

a cam transmission assembly comprising a drive gear rotatably coupled to the axle;

an idler assembly having an idler axle that is spaced apart from the axle, and including a first idler gear that engages the drive gear, and a second idler gear, the first and second idler gears being rotatably coupled to the idler axle; and a cam gear rotatably coupled to the cam and the cam gear positioned so as to engage the second idler gear; and a motor having an output shaft, with the output shaft being rotatably coupled to the axle.

2. The can seamer of claim 1 wherein an angular position of the first rotating shaft and the first roller follower assembly is adjustable.

3. The can seamer of claim 2 wherein the first rotating shaft includes an outer surface and a fastener surface, and, the first roller follower assembly includes a central opening with a pair of spaced apart transverse bores, with a first fastener extending through a first of the pair of spaced apart transverse bores and engaging the fastener surface, and, a second fastener extending through a second of the pair of spaced apart transverse bores and engaging the fastener surface.

4. The can seamer of claim 2 wherein the first seam forming assembly further includes a first roller support arm at a lower end of the first rotating shaft, the first roller support arm having a distal end, with an adjustable stop at the distal end of the first roller support arm, and the roller being coupled to the first roller support between the first rotating shaft and the adjustable stop.

5. The can seamer of claim 4 wherein the first adjustable stop comprising a fastener threaded into the first roller support arm, the fastener having a chuck interface surface configured to interface with the upper chuck.

6. The can seamer of claim 2 wherein the first roller follower rotates about an axis that is parallel to an axis defined by the first rotating shaft.

7. The can seamer of claim 2 wherein the second roller follower rotates about an axis that is parallel to an axis defined by the second rotating shaft.

8. The can seamer of claim 1 wherein an angular position of the second rotating shaft and the second roller follower assembly is adjustable.

9. The can seamer of claim 8 wherein the second rotating shaft includes an outer surface and a fastener surface, and, the second roller follower assembly includes a central opening with a pair of spaced apart transverse bores, with a first fastener extending through a first of the pair of spaced apart transverse bores and engaging the fastener surface, and, a second fastener extending through a second of the pair of spaced apart transverse bores and engaging the fastener surface.

10. The can seamer of claim 8 wherein the second seam forming assembly further includes a second roller support arm at a lower end of the second rotating shaft, the second roller support arm having a distal end, with an adjustable stop at the distal end of the second roller support arm, and the roller being coupled to the second roller support between the second rotating shaft and the adjustable stop.

11. The can seamer of claim 10 wherein the second adjustable stop comprising a fastener threaded into the second roller support arm, the fastener having a chuck interface surface configured to interface with the upper chuck.

12. The can seamer of claim 1 wherein the axle and the idler axle are parallel to each other in a space apart configuration.

13. The can seamer of claim 12 wherein the motor includes an output shaft, wherein the output shaft is parallel to the axle and the idler axle.

14. The can seamer of 1 wherein the lower chuck is slidably movable relative to the frame toward and away from the upper chuck.

15. The can seamer of claim 14 wherein the lower chuck is coupled to an overcenter mechanism, structurally configured to lock the lower chuck relative to the upper chuck.

16. The can seamer of claim 1 wherein the cam further includes a cam lobe defined on the outer surface, and, a slot defined in the cam proximate the cam lobe.

17. The can seamer of claim 1 wherein the frame further includes an upper frame portion, with the first rotating shaft, the second rotating shaft and the axle each extending through an opening in the upper frame portion.

18. The can seamer of claim 17 wherein the frame further includes a rear projection extending in a direction away from the upper frame portion and terminating at a distal end, the first roller follower assembly including a first return spring coupled to a body of the first roller follower at a first end and to the rear projection at a second end and the second roller follower assembly including a second return spring coupled to the a body of the second roller follower at a first end and to the rear projection at a second end.

19. The can seamer of claim 18 wherein the second end of the first return spring and the second end of the second return spring are positioned closer to each other than the first end of the first return spring and the first end second return spring.

20. The can seamer of claim 19 wherein the first and second return springs extend under the first idler gear.

* * * * *